US007162863B2

(12) United States Patent
Suzuki et al.

(10) Patent No.: US 7,162,863 B2
(45) Date of Patent: Jan. 16, 2007

(54) EXHAUST GAS PURIFYING APPARATUS FOR INTERNAL COMBUSTION ENGINE

(75) Inventors: Norio Suzuki, Wako (JP); Katsuji Wada, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 76 days.

(21) Appl. No.: 11/012,143

(22) Filed: Dec. 16, 2004

(65) Prior Publication Data

US 2005/0166579 A1 Aug. 4, 2005

(30) Foreign Application Priority Data

Jan. 30, 2004 (JP) ..... 2004-022740

(51) Int. Cl.
*F01N 3/00* (2006.01)

(52) U.S. Cl. ..... 60/285; 60/274; 60/286; 60/297; 60/301

(58) Field of Classification Search ..... 60/274, 60/276, 285, 286, 297, 301
See application file for complete search history.

(56) References Cited

U.S. PATENT DOCUMENTS 5,964,088 A * 10/1999 Kinugasa et al. ..... 60/286
6,176,079 B1 1/2001 Konrad et al.
6,301,878 B1 * 10/2001 Zhang et al. ..... 60/274
6,338,244 B1 1/2002 Guenther et al.
6,698,188 B1 * 3/2004 Irisawa et al. ..... 60/285
6,732,507 B1 5/2004 Stanglmaier et al.
6,742,330 B1 * 6/2004 Genderen ..... 60/286
6,959,540 B1 * 11/2005 Itoh et al. ..... 60/286
2004/0040288 A1 3/2004 Eberhard et al.

FOREIGN PATENT DOCUMENTS

| | | |
|---|---|---|
| EP | 0 972 927 A2 | 1/2000 |
| EP | 2000-213337 | 8/2000 |
| EP | 2002-097941 | 4/2002 |
| EP | 1 357 267 | 10/2003 |
| JP | 06-010725 | 1/1994 |
| JP | 6-10725 | 1/1994 |

* cited by examiner

*Primary Examiner*—Binh Q. Tran
(74) *Attorney, Agent, or Firm*—Arent Fox PLLC

(57) ABSTRACT

An exhaust gas purifying apparatus for an internal combustion engine having an exhaust system. The exhaust gas purifying apparatus includes a NOx purifying device provided in the exhaust system for purifying NOx in exhaust gases, and a temperature sensor for detecting a temperature of the NOx purifying device. The NOx purifying device has NOx adsorbing capacity and generates ammonia and retains the generated ammonia when the air-fuel ratio is set to a value on the rich side with respect to the stoichiometric ratio. The NOx purifying device purifies NOx with the retained ammonia when the air-fuel ratio is set to a value on a lean side with respect to the stoichiometric ratio. The air-fuel ratio is enriched to a value on the rich side with respect to the stoichiometric ratio so as to increase an amount of reducing components in the exhaust gases flowing into the NOx purifying device.

12 Claims, 5 Drawing Sheets

EXHAUST GAS PURIFYING APPARATUS FOR INTERNAL COMBUSTION ENGINE

BACKGROUND OF THE INVENTION

1. Field of the Invention

The present invention relates to an exhaust gas purifying apparatus for an internal combustion engine, and particularly, to an exhaust gas purifying apparatus provided with a NOx purifying device having NOx adsorbing capacity.

2. Description of the Related Art

The exhaust gas purifying apparatus provided with the NOx purifying device, containing a NOx absorbent for absorbing NOx, is shown in Japanese Patent Laid-open No. Hei 6-10725. In this apparatus, when the amount of NOx absorbed by the NOx purifying device reaches a predetermined amount, the air-fuel ratio of air-fuel mixture supplied to the engine is set to a value on a rich side with respect to the stoichiometric ratio, and the absorbed NOx is reduced.

According to this exhaust gas purifying apparatus, the air-fuel ratio enrichment for reducing absorbed NOx is performed so that a degree of the enrichment may become larger, and the enrichment execution period may become shorter as the exhaust gas temperature becomes higher. This is intended to obtain an appropriate balance between the NOx discharging amount from the NOx absorbent and the amount of reducing components in the exhaust gases, considering that the NOx discharging characteristic of the NOx absorbent changes depending on its temperature, i.e., the NOx discharging speed (discharging amount per unit time period) is comparatively low when the temperature is low and becomes higher as the temperature rises.

In the above-described conventional apparatus, the amount of enrichment is controlled to be small so that an amount of ammonia generated in the apparatus may not increase when the exhaust gas temperature is low. However, if using a NOx purifying device having a capacity for retaining the generated ammonia, it is not necessary to suppress the generation of ammonia. It is rather desirable to increase the amount of ammonia generated, since the retained ammonia can reduce NOx upon the lean burn operation of the engine.

SUMMARY OF THE INVENTION

It is an object of the present invention to provide an exhaust gas purifying apparatus, which can raise a NOx purification rate particularly when the temperature of the NOx purifying device is low, by using ammonia generated when enriching the air-fuel ratio for NOx reduction upon lean burn operation of the engine.

In order to attain the above object, an exhaust gas purifying apparatus for an internal combustion engine (1) having an exhaust system (13) provided with NOx purifying means (15) which has NOx adsorbing capacity for purifying NOx in exhaust gases. The NOx purifying means (15) generates ammonia and retains the generated ammonia when an air-fuel ratio of an air-fuel mixture, which burns in the engine, is set to a value on a rich side with respect to a stoichiometric ratio. The NOx purifying means purifies NOx with the retained ammonia when the air-fuel ratio is set to a value on a lean side with respect to the stoichiometric ratio. The exhaust gas purifying apparatus further includes temperature detecting means (16) for detecting a temperature (TOAT) of the NOx purifying means (15), and enriching means (S17–S21) for enriching the air-fuel ratio to a value on the rich side with respect to the stoichiometric ratio so as to increase an amount of reducing components in the exhaust gases flowing into the NOx purifying means (15). The enriching means includes conversion rate calculating means (S17) and enrichment parameter setting means (S18, S20). The conversion rate calculating means calculates a rate (Ktemp) of conversion from NOx to ammonia in the NOx purifying means (15) according to the temperature (TCAT) detected by the temperature detecting means. The enrichment parameter setting means (S18, S20) sets an enrichment parameter according to the calculated conversion rate (Ktemp). The enriching means performs the enrichment based on the set enrichment parameter.

With this configuration, the rate of conversion from NOx to ammonia in the NOx purifying means is calculated according to the temperature of the NOx purifying means, and the enrichment parameter is set according to the calculated conversion rate. Generation of ammonia when enriching the air-fuel ratio is highly temperature dependent, and the amount of ammonia generated decreases when the temperature of the NOx purifying means falls. Therefore, when the temperature of the NOx purifying means is low, by setting the enrichment parameter according to the rate of conversion from NOx to ammonia, the amount of ammonia generated can be increased to thereby raise the NOx purification rate upon the lean burn operation of the engine.

Preferably, the exhaust gas purifying apparatus further includes NOx amount calculating means for calculating an amount of NOx adsorbed by the NOx purifying means. The enriching means starts enriching the air-fuel ratio when the calculated amount of NOx reaches a predetermined threshold value, and terminates enriching the air-fuel ratio when the calculated amount of NOx decreases substantially to "0".

Preferably, the predetermined threshold value is set according to the detected temperature of the NOx purifying means.

Preferably, the enrichment parameter is an execution time period of the enrichment performed by the enriching means.

With this configuration, the execution time period of the enrichment is set according to the rate of conversion from NOx to ammonia. Therefore, by lengthening the enrichment execution time period according to the rate of conversion to ammonia, when the temperature of the NOx purifying means is low, the amount of ammonia generated increases and the generated ammonia is retained in the NOx purifying means. As a result, the NOx purification rate upon the lean burn operation can be faster.

Alternatively, the enrichment parameter may be a degree of the enrichment performed by the enriching means.

Preferably, the rate of conversion from NOx to ammonia is calculated so that it decreases as the detected temperature of the NOx purifying means becomes lower.

DETAILED DESCRIPTION OF THE PREFERRED EMBODIMENTS

Preferred embodiments of the present invention will now be described with reference to the drawings.

Figure 1:
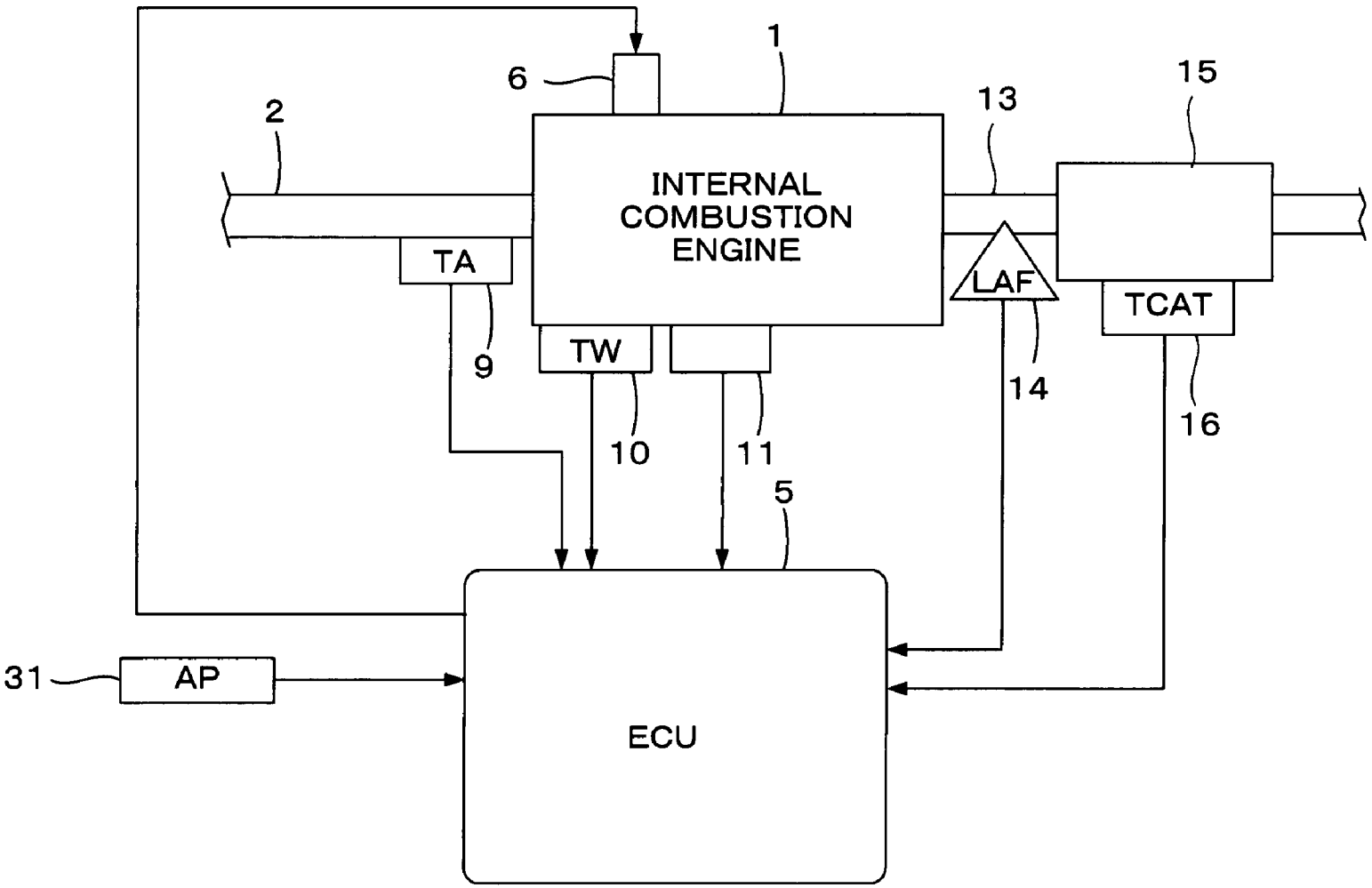
FIG. 1 is a schematic diagram showing a configuration of an internal combustion engine and an exhaust gas purifying apparatus therefor according to one embodiment of the present invention.

FIG. 1 is a schematic diagram showing a configuration of an internal combustion engine and its exhaust gas purifying apparatus according to one embodiment of the present invention. In FIG. 1, the internal combustion engine 1 (hereinafter referred to simply as "engine") having 4 cylinders, for example, may be a diesel engine in which fuel is directly injected into combustion chambers. A fuel injection valve 6 is disposed in each cylinder. The fuel injection valve 6 is electrically connected to an electronic control unit 5 (hereinafter referred to as "ECU"), and the valve opening period of the fuel injection valve 6 is controlled by the ECU 5.

An intake air temperature (TA) sensor 9 is mounted in an intake pipe 2. The sensor 9 detects an intake air temperature TA and a corresponding electrical signal is output and supplied to the ECU 5.

An engine coolant temperature (TW) sensor 10, such as a thermistor, is mounted on the body of the engine 1 to detect an engine coolant temperature TW (cooling water temperature). A temperature signal, corresponding to the detected engine coolant temperature TW, is output from the sensor 10 and supplied to the ECU 5.

A crank angle position sensor 11 for detecting a rotational angle of a crankshaft (not shown) of the engine 1 is connected to the ECU 5, and a signal corresponding to the detected rotational angle of the crankshaft is supplied to the ECU 5. The crank angle position sensor 11 consists of a cylinder discrimination sensor, a TDC sensor, and a CRK sensor. The cylinder discrimination sensor outputs a pulse (hereinafter referred to as "CYL pulse") at a predetermined crank angle position for a specific cylinder of the engine 1. The TDC sensor outputs a TDC pulse at a crank angle position before a top dead center (TDC) by a predetermined crank angle starting at an intake stroke in each cylinder (at every 180-degree crank angle in the case of a four-cylinder engine). The CRK sensor generates one pulse (hereinafter referred to as "CRK pulse") with a constant crank angle period (e.g., a period of 30 degrees) shorter than the period of generation of the TDC pulse. Each of the CYL pulse, the TDC pulse, and the CRK pulse is supplied to the ECU 5. These pulses are used to control various timings, such as fuel injection timing and ignition timing, and for detection of an engine rotational speed NE.

An exhaust pipe 13 of the engine 1 is provided with an oxygen concentration sensor 14 (hereinafter referred to as "LAF sensor") for detecting an oxygen concentration in exhaust gases. A NOx purifying device 15 is provided downstream of the oxygen concentration sensor 14. The oxygen concentration sensor 14 outputs a detection signal, which is proportional to the oxygen concentration in the exhaust gases (air-fuel ratio), and supplies the detection signal to the ECU 5.

The NOx purifying device 15 includes platinum (Pt) as a catalyst, ceria ($CeO_2$) as a NOx adsorbent having NOx adsorbing capacity, and zeolite for retaining ammonia ($NH_3$) in the exhaust gases as ammonium ion ($NH_4^+$). The platinum is carried by an alumina ($Al_2O_3$) carrier.

The NOx purifying device 15 is provided with a catalyst temperature sensor 16, which detects a temperature TCAT of the catalyst in the NOx purifying device 15, and the detection signal output from the sensor 16 is supplied to the ECU 5. Further, an accelerator sensor 31, which detects a depressing amount AP of the accelerator pedal of the vehicle driven by the engine 1 (hereinafter referred to as "accelerator pedal operation amount AP"), is connected to the ECU 5, and the detection signal output from the sensor 31 is supplied to the ECU 5.

The ECU 5 includes an input circuit, a central processing unit (hereinafter referred to as "CPU"), a memory circuit, and an output circuit. The input circuit performs numerous functions, including shaping the waveforms of input signals from the various sensors, correcting the voltage levels of the input signals to a predetermined level, and converting analog signal values into digital signal values. The memory circuit preliminarily stores various operating programs to be executed by the CPU and stores the results of computations, or the like, by the CPU. The output circuit supplies drive signals to the fuel injection valves 6.

The CPU in the ECU 5 computes a fuel injection period TOUT of each fuel injection valve 6 to be opened in synchronism with the TDC pulse according to the output signals from the sensors mentioned above. The fuel injection period TOUT is calculated from equation (1) described below.

$$TOUT=TIM\times KCMD\times KLAF\times K1+K2 \quad (1)$$

In this equation, TIM is a basic fuel amount, specifically a basic fuel injection period of the fuel injection valve 6. The basic fuel amount TIM is determined by retrieving a TI map (not shown) which is set according to the engine rotational speed NE and the accelerator pedal operation amount AP.

KCMD is a target air-fuel ratio coefficient, which is set according to engine operating parameters such as the engine rotational speed NE, the accelerator pedal operation amount AP, and the engine coolant temperature TW. The target air-fuel ratio coefficient KCMD is proportional to the reciprocal of an air-fuel ratio A/F, i.e., proportional to a fuel-air ratio F/A, and takes a value of 1.0 for the stoichiometric ratio. Therefore, KCMD is also referred to as a target equivalent ratio. Further, when performing air-fuel ratio enrichment for reducing NOx adsorbed in the NOx purifying device 15 (hereinafter referred to as "reduction enrichment"), the target air-fuel ratio coefficient KCMD is set to a predetermined enrichment value KCMDR (>1.0). An amount (a concentration) of reducing components (HC, CO) in the exhaust gases increases upon execution of the air-fuel ratio enrichment.

KLAF is an air-fuel ratio correction coefficient calculated so that a detected equivalent ratio KACT, calculated from a detected value from the LAF sensor 14, becomes equal to the target equivalent ratio KCMD when the conditions for execution of feedback control are satisfied.

K1 is a correction coefficient and K2 is a correction variable computed according to engine operating conditions. The correction coefficient K1 and correction variable K2 are set to predetermined values that optimize various characteristics such as fuel consumption characteristics and engine acceleration characteristics according to the engine operating conditions.

Figure 2A:
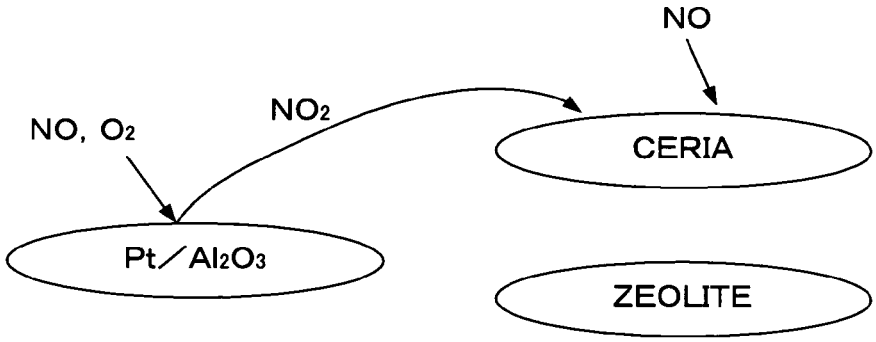
FIGS. 2A–2C are figures for illustrating the NOx purifying device shown in FIG. 1.

FIG. 2 is a figure for illustrating the NOx purification in the NOx purifying device 15. First, in the initial condition, when the air-fuel ratio of the air-fuel mixture, which burns in the engine 1, is set to a value on the lean side with respect to the stoichiometric ratio, i.e., the so-called lean-burn operation is performed, NO (nitric oxide) and oxygen ($O_2$) in the exhaust gases react by the action of the catalyst, to be adsorbed by the ceria as $NO_2$, as shown in FIG. 2A. Further, the nitric oxide, which has not reacted with oxygen, is also adsorbed by the ceria.

Figure 2B:
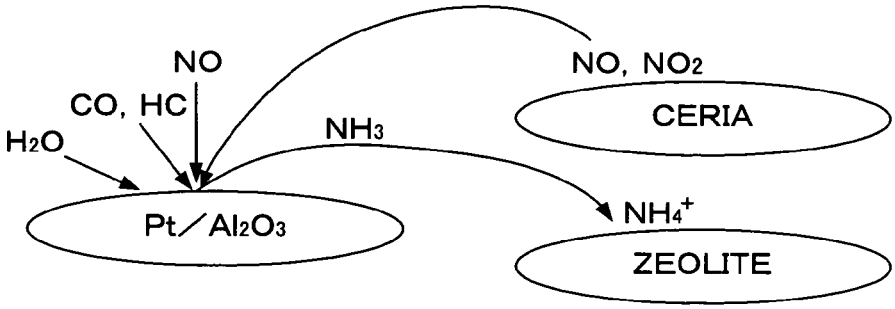

Next, when the air-fuel ratio is set to a value on the rich side with respect to the stoichiometric ratio, the carbon monoxide (CO) in the exhaust gases reacts with water ($H_2O$), generating carbon dioxide ($CO_2$) and hydrogen ($H_2$). Further, hydrocarbon (HC) in the exhaust gases reacts with water, generating hydrogen as well as carbon monoxide and carbon dioxide. Furthermore, as shown in FIG. 2B, NOx contained in the exhaust gases and NOx (NO, $NO_2$) currently adsorbed by the ceria (and the platinum) react with the generated hydrogen by the action of the catalyst to generate ammonia ($NH_3$) and water. These reactions are expressed by the following chemical equations (2)–(4).

$$CO+H_2O \rightarrow CO_2+H_2 \quad (2)$$

$$2NO_2+7H_2 \rightarrow 2NH_3+4H_2O \quad (3)$$

$$2NO+5H_2 \rightarrow 2NH_3+2H_2O \quad (4)$$

The generated ammonia is adsorbed by the zeolite in the form of ammonium ion ($NH_4^+$).

Figure 2C:
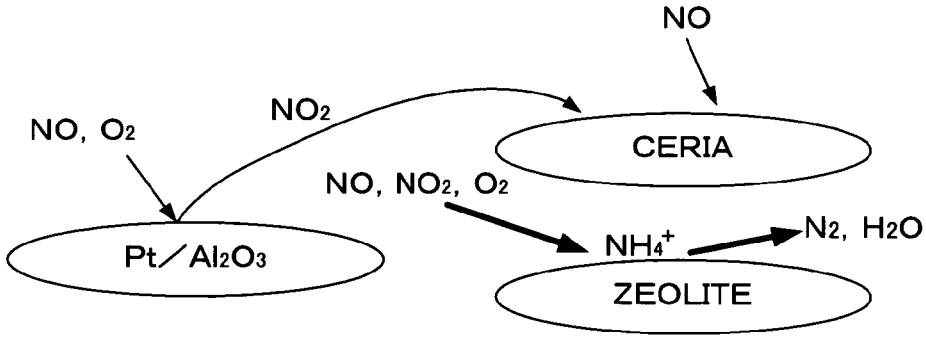

Next, when the air-fuel ratio is set to a value on the lean side with respect to the stoichiometric ratio to perform the lean burn operation, NOx is adsorbed by the ceria as shown in FIG. 2C, like FIG. 2A. Further, under the condition where ammonium ions are adsorbed by the zeolite, NOx and oxygen in the exhaust gases react with ammonia, to generate nitrogen ($N_2$) and water, as expressed by the following equations (5) and (6).

$$4NH_3+4NO+O_2 \rightarrow 4N_2+6H_2O \quad (5)$$

$$2NH_3+NO+NO_2 \rightarrow 2N_2+3H_2O \quad (6)$$

As described above, according to the NOx purifying device 15, the ammonia generated during the rich operation, in which the air-fuel ratio is set to a value on the rich side with respect to the stoichiometric ratio, is adsorbed by the zeolite, and the adsorbed ammonia reacts as a reducing agent with NOx during the lean burn operation. Accordingly, NOx can be efficiently purified.

Figure 3:
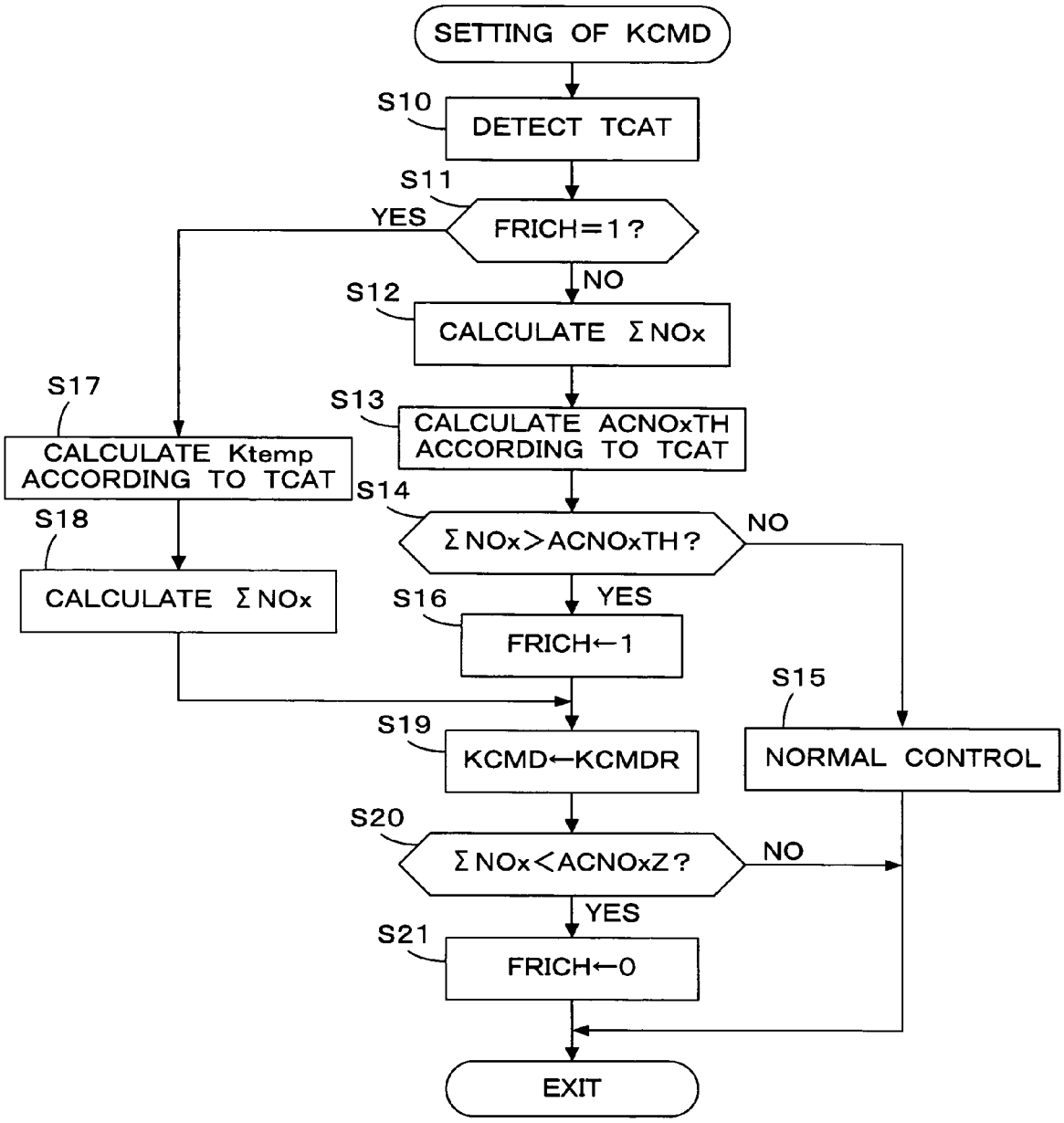
FIG. 3 is a flowchart of a process for setting a target air-fuel ratio coefficient (KCMD)

FIG. 3 is a flowchart of a process for setting the target air-fuel ratio coefficient KCMD, which is applied to the above-described equation (1). This process is executed by the CPU in the ECU 5 in synchronism with generation of the TDC pulse.

In step S10, the catalyst temperature TCAT, detected by the catalyst temperature sensor 16, is read in. In step S11, it is determined whether or not an enrichment flag FRICH is "1". The enrichment flag FRICH is set to "1" when performing the reduction enrichment. If FRICH is equal to "0", an accumulated NOx amount Σ NOx is calculated by the following equation (8) (step S12). The accumulated NOx amount Σ NOx is a parameter indicative of an amount of NOx adsorbed by the ceria in the NOx purifying device 15.

$$\Sigma\ NOx=\Sigma\ NOx+QAIR\times Mnox \quad (8)$$

In the above equation, QAIR is an exhaust flow rate which is calculated by multiplying the basic fuel amount TIM by a conversion coefficient. Mnox is a NOx concentration map value calculated according to the engine rotational speed NE and the accelerator pedal operation amount AP.

Figure 4A:
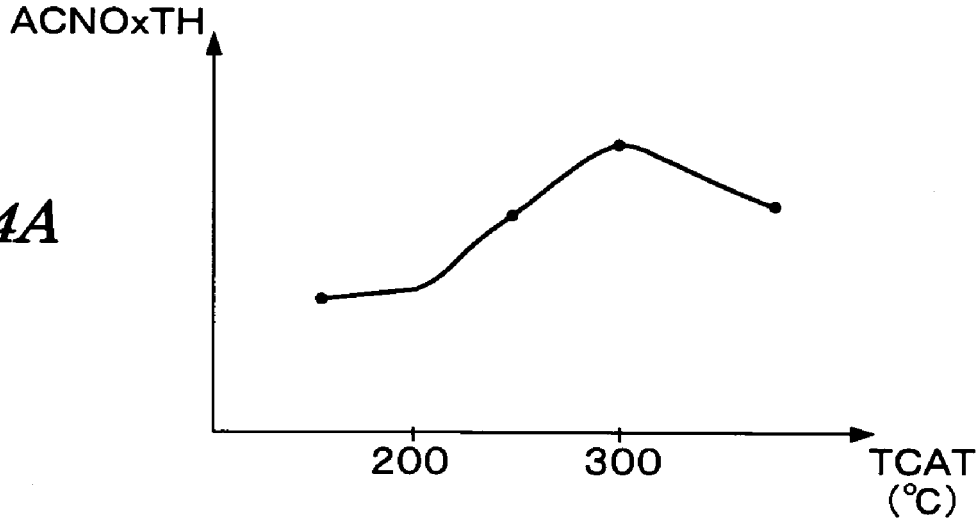
FIGS. 4A and 4B show tables used in the process shown in FIG. 3.

In step S13, an ACNOxTH table shown in FIG. 4A is retrieved according to the catalyst temperature TCAT to determine a first threshold value ACNOxTH. The ACNOxTH table is set so that the first threshold value ACNOxTH may increase as the catalyst temperature TCAT becomes higher in the range of 200 to 300 degrees Centigrade. The first threshold value ACNOxTH is set to a predetermined value which is less than the maximum amount of NOx which can be adsorbed by the ceria (and the platinum) in the NOx purifying device 15.

In step S14, it is determined whether or not the accumulated NOx amount Σ NOx is greater than the first threshold value ACNOxTH. If ΣNOx is less than ACNOxTH, the process proceeds to step S15, in which a normal control is performed, i.e., the target air-fuel ratio coefficient KCMD is set according to the engine operating condition. The target air-fuel ratio coefficient KCMD is basically calculated according to the engine rotational speed NE and the accelerator pedal operation amount AP. In a condition where the engine coolant temperature TW is low or in a predetermined high-load operating condition, the calculated value of the target air-fuel ratio coefficient KCMD is changed according to these conditions.

If Σ NOx is greater than or equal to ACNOxTH in step S14, the process proceeds to step S16, in which the enrichment flag FRICH is set to "1".

In step S19, the target air-fuel ratio coefficient KCMD is set to an enrichment predetermined value KCMDR (for example, "1.05"), and the reduction enrichment is performed. In step S20, it is determined whether or not the accumulated NOx amount ΣNOx is less than a second threshold value ACNOxZ. The second threshold value ACNOxZ is a threshold value for determining a termination timing of the reduction enrichment and is set to a value which is slightly greater than "0". When the answer to step S20 is negative (NO), this process immediately ends. Accordingly, the reduction enrichment is continued.

Figure 4B:
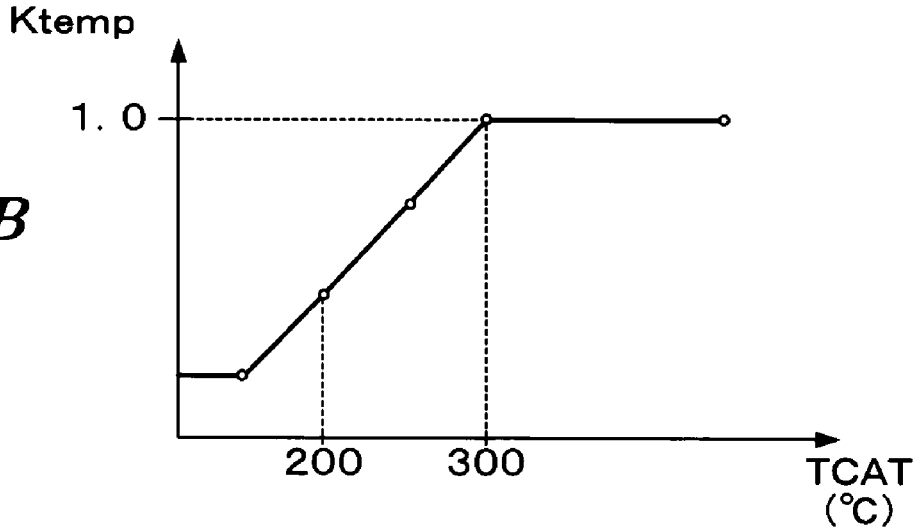

After the enrichment flag FRICH is set to "1" in step S16, the process proceeds from step S11 to step S17, in which a Ktemp table shown in FIG. 4B is retrieved according to the catalyst temperature TCAT, to calculate an NH3 generation temperature coefficient Ktemp. The Ktemp table is set so that the NH3 generation temperature coefficient Ktemp may decrease as the catalyst temperature TCAT becomes lower in the range where the catalyst temperature TCAT is lower than or equal to 300 degrees Centigrade. The NH3 generation temperature coefficient Ktemp is a parameter corresponding to a rate of conversion of NOx to ammonia in the NOx purifying device 15 (hereinafter referred to as "NOx-ammonia conversion rate"). A large value of the NH3 generation temperature coefficient Ktemp indicates that the rate of conversion from NOx to ammonia is high. In other words, the rate of conversion from NOx to ammonia becomes higher as the NH3 generation temperature coefficient Ktemp increases.

In step S18, the NH3 generation temperature coefficient Ktemp is applied to the following equation (9), to calculate the accumulated NOx amount Σ NOx.

$$\Sigma\ NOx=\Sigma\ NOx-QAIR\times Dnox\times Ktemp \quad (9)$$

In this equation, Dnox is a NOx reduction rate map value which is calculated according to the engine rotational speed NE and the accelerator pedal operation amount AP. According to the equation (9), the accumulated NOx amount Σ NOx, which is reduced by the reduction enrichment, is calculated.

After execution of step S18, the process proceeds to step S19 described above. If reduction of NOx proceeds thereafter and the answer to step S20 becomes affirmative (YES), the process proceeds to step S21, in which the enrichment flag FRICH is returned to "0".

As described above, in the process of FIG. 3, the NH3 generation temperature coefficient Ktemp is set so that it may decrease as the catalyst temperature TCAT becomes lower in the temperature range below 300 degrees Centigrade. Therefore, the decreasing speed of the accumulated NOx amount Σ NOx calculated by the equation (9) becomes lower as the catalyst temperature TCAT becomes lower, and hence, the execution time period for the reduction enrichment becomes longer.

Figure 5:
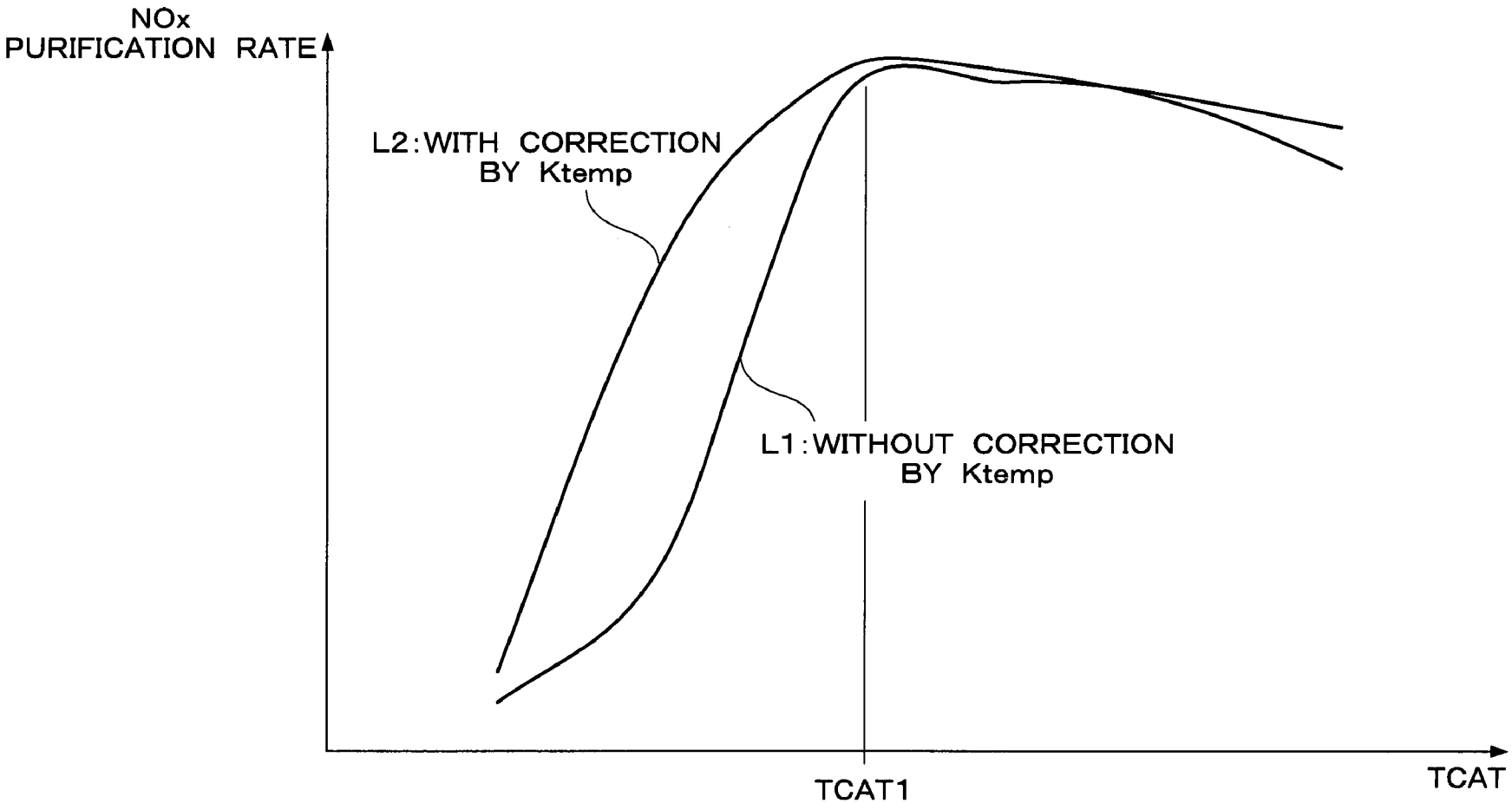
FIG. 5 shows a relation between a catalyst temperature (TCAT) and a NOx purification rate of the NOx purifying device.

FIG. 5 shows a relation between the catalyst temperature TCAT and a NOx purification rate of the NOx purifying device 15. In FIG. 5, the line L1 corresponds to an occasion where the correction by the NH3 generation temperature coefficient Ktemp is not performed, while the line L2 corresponds to an occasion where the correction by the NH3 generation temperature coefficient Ktemp is performed. The catalyst temperature TCAT1 shown in FIG. 5 is about 300 degrees Centigrade, for example. As shown in FIG. 5, by correcting the NOx reduction amount by the NH3 generation temperature coefficient Ktemp according to the catalyst temperature TCAT, the enrichment execution time period can be properly selected, and a proper amount of ammonia generated. Accordingly, reduction of the NOx purification rate can be suppressed in the range where the catalyst temperature TCAT is low.

In this embodiment, the NOx purifying device 15 corresponds to the NOx purifying means, and the catalyst temperature sensor 16 corresponds to the temperature detecting means. Further, the ECU 5 constitutes the enriching means, and steps S1–S20 of FIG. 3 correspond to the enriching means. Specifically, step S17 corresponds to the conversion rate calculating means, step S18 and step S20 correspond to the enrichment parameter setting means, and steps S12 and S18 correspond to the NOx amount calculating means.

The present invention is not limited to the embodiment described above, and various modifications may be made. For example, in the above embodiment, the NH3 generation temperature coefficient Ktemp is set according to the catalyst temperature TCAT, to thereby change the enrichment execution time period. Alternatively, the enrichment predetermined value KCMDR (enrichment degree) may be changed according to the NH3 generation temperature coefficient Ktemp. In such embodiment, the enrichment predetermined value KCMDR may be set so that it may increase as the NH3 generation temperature coefficient Ktemp decreases. In such embodiment, the enrichment degree determined by the enrichment predetermined value KCMDR corresponds to the "enrichment parameter" in the claimed invention.

Further, the enrichment execution time period may be made longer as the catalyst temperature TCAT becomes lower, and the target air-fuel-ratio coefficient KCMD may be set so that the enrichment degree may increase as the catalyst temperature TCAT becomes lower.

In the above-described embodiment, an example, in which the present invention is applied to a diesel internal combustion engine, is shown. The present invention is applicable also to a gasoline internal combustion engine. Furthermore, the present invention can be applied also to the air-fuel ratio control for a watercraft propulsion engine, such as an outboard engine having a vertically extending crankshaft.

The present invention may be embodied in other specific forms without departing from the spirit or essential characteristics thereof. The presently disclosed embodiments are therefore to be considered in all respects as illustrative and not restrictive, the scope of the invention being indicated by the appended claims, rather than the foregoing description, and all changes which come within the meaning and range of equivalency of the claims are, therefore, to be embraced therein.

What is claimed is:

1. An exhaust gas purifying apparatus for an internal combustion engine having an exhaust system, comprising:

NOx purifying means provided in said exhaust system for purifying NOx in exhaust gases, said NOx purifying means having NOx adsorbing capacity;

temperature detecting means for detecting a temperature of said NOx purifying means; and enriching means for setting an air-fuel ratio of an air-fuel mixture, which burns in said engine, to a value on a rich side with respect to a stoichiometric ratio so as to increase an amount of reducing components in the exhaust gases flowing into said NOx purifying means, wherein said NOx purifying means generates ammonia from the adsorbed NOx and retains the generated ammonia when the air-fuel ratio is set to a value on the rich side with respect to the stoichiometric ratio, said NOx purifying means purifying NOx with the retained ammonia when the air-fuel ratio is set to a value on a lean side with respect to the stoichiometric ratio, wherein said enriching means comprises conversion rate calculating means for calculating a rate of conversion from the adsorbed NOx to ammonia in said NOx purifying means according to the temperature detected by said temperature detecting means, and enrichment parameter setting means for setting an enrichment parameter according to the calculated conversion rate, and wherein said enriching means performs the enrichment based on the set enrichment parameter.

2. An exhaust gas purifying apparatus according to claim 1, further including NOx amount calculating means for calculating an amount of NOx adsorbed by said NOx purifying means, wherein said enriching means starts the enrichment when the calculated amount of NOx reaches a predetermined threshold value, and terminates the enrichment when the calculated amount of NOx decreases substantially to "0".

3. An exhaust gas purifying apparatus according to claim 2, wherein the predetermined threshold value is set according to the detected temperature of said NOx purifying means.

4. An exhaust gas purifying apparatus according to claim 1, wherein the enrichment parameter is an execution time period of the enrichment performed by said enriching means.

5. An exhaust gas purifying apparatus according to claim 1, wherein the enrichment parameter is a degree of the enrichment performed by said enriching means.

6. An exhaust gas purifying apparatus according to claim 1, wherein the rate of conversion from NOx to ammonia decreases as the detected temperature of said NOx purifying means becomes lower.

7. An exhaust gas purifying method for an internal combustion engine having an exhaust system, comprising:

a) providing a NOx purifying device in said exhaust system for purifying NOx in exhaust gases, said NOx purifying device having NOx adsorbing capacity;

b) detecting a temperature of said NOx purifying device;

c) calculating a rate of conversion from the adsorbed NOx to ammonia in said NOx purifying device according to the detected temperature;

d) setting an enrichment parameter according to the calculated conversion rate; and e) setting an air-fuel ratio of an air-fuel mixture, which burns in said engine, based on the set enrichment parameter to a value on a rich side with respect to a stoichiometric ratio so as to increase an amount of reducing components in the exhaust gases flowing into said NOx purifying device, wherein said NOx purifying device generates ammonia from the adsorbed NOx and retains the generated ammonia when the air-fuel ratio is set to a value on the rich side with respect to the stoichiometric ratio, said NOx purifying device purifying NOx with the retained ammonia when the air-fuel ratio is set to a value on a lean side with respect to the stoichiometric ratio.

8. An exhaust gas purifying method according to claim 7, further including the step of calculating an amount of NOx adsorbed by said NOx purifying device, wherein said step e) of performing the enrichment is started when the calculated amount of NOx reaches a predetermined threshold value, and terminated when the calculated amount of NOx decreases substantially to "0".

9. An exhaust gas purifying method according to claim 8, wherein the predetermined threshold value is set according to the detected temperature of said NOx purifying device.

10. An exhaust gas purifying method according to claim 7, wherein the enrichment parameter is an execution time period of the enrichment performed in said step e).

11. An exhaust gas purifying method according to claim 7, wherein the enrichment parameter is a degree of the enrichment performed in said step e).

12. An exhaust gas purifying method according to claim 7, wherein the rate of conversion from NOx to ammonia decreases as the detected temperature of said NOx purifying device becomes lower.

* * * * *